United States Patent [19]

Kerttula

[11] Patent Number: 4,888,883

[45] Date of Patent: Dec. 26, 1989

[54] DRAWING A WEB THROUGH A MULTI-CYLINDER DRYING SECTION

[75] Inventor: Reima Kerttula, Charlotte, N.C.

[73] Assignee: Valmet Paper Machinery Inc., Finland

[21] Appl. No.: 178,208

[22] Filed: Apr. 6, 1988

[30] Foreign Application Priority Data

Apr. 6, 1987 [FI] Finland ..... 871493

[51] Int. Cl.[4] ..... F26B 11/02

[52] U.S. Cl. ..... 34/116; 34/123

[58] Field of Search ..... 34/155, 156, 116, 113, 34/123, 117, 118, 120

[56] References Cited

U.S. PATENT DOCUMENTS 4,566,946 1/1986 Koponen et al. ..... 34/116 X 4,625,430 12/1986 Aula et al. ..... 34/116 X

*Primary Examiner*—Henry A. Bennet

*Attorney, Agent, or Firm*—Steinberg & Raskin

[57] ABSTRACT

A multiculer dryer in a paper machine, having several successive cylinder sections of which one or more are equipped with a twin-wire draw in a manner such that a web being dried is drawn unsupported between cylinder rows. A closed draw is used in section gaps in a manner such that a drawing or supporting wire of a preceding section is conveyed to contact a top cylinder of a following section at a small angle. A special section gap cylinder is used near the section gap, the cylinder either not being driven or which from a point of view of the drive, belongs to the preceding drying section. The drying wire of the preceding section is wound over the section gap cylinder, preferably over a sector greater than about 180°, this drying wire either being a single wire-wire draw drying wire or a top wire of a preceding section twin-wire draw. The web supported by the wire is guided as an essentially vertical run from the sector of the section gap cylinder to the top cylinder of the next section. There is an open space below the section gap cylinder which allows a waste web to be removed by gravity.

29 Claims, 2 Drawing Sheets

DRAWING A WEB THROUGH A MULTI-CYLINDER DRYING SECTION

BACKGROUND OF THE INVENTION

The present invention relates to a multicylinder dryer of a paper machine, which comprises several successive cylinder sections of which one or more are equipped with a twin-wire draw in such a way that the web being dried is drawn between the cylinder rows unsupported, and in which a closed draw is used in section gaps in a manner such that the drying or supporting wire of the preceding section is led to touch the top cylinder of the following section at a certain small angle.

As is known, a multicylinder dryer of a paper machine comprises two rows of drying cylinders on top of each other, the web being guided zigzag over these cylinder rows. Different sections, such as wire sections and drive sections are used in the multi-cylinder dryer. In the drive sections, the rotating power is conveyed to all cylinders of the section by the same drive shaft and by a gear transmission.

In the prior art, a so called twin-wire draw is used in multi-cylinder drying sections, in which the paper web has free draws when it moves from one cylinder row to another. Also, a so-called single-wire draw is used particularly in the beginning of the multi-cylinder dryer. In such a single-wire draw, the drying wire is also arranged to support the web when it moves from one cylinder row to another. Then, the drying cylinders of one cylinder row are within the drying wire loop and the the drying cylinders of the other cylinder row are outside the drying wire loop.

Drawing the paper web over the section gaps of a multi-cylinder dryer has been a problem when using arrangements of the prior art. If a free draw is used in a section gap, the web will flutter which causes risks of breaking and worsens running ability. It also has been necessary to use a considerably high speed difference in the section gaps, which detremintally stretches the web.

Efforts have been made to solving these web drawing problems in the section gaps of a multi-cylinder dryer, with various methods such as overlapping the wire guiding rolls aimed at closing the free web draws in the section gaps. Various blow boxes have also been used. However, it has not been possible to avoid all problems or difficulties with these method. An additional difficulty has been that drawing of the end of the web has become more difficult.

Another known solution for avoiding said drawbacks has been a so-called "Pistol-Grip" draw. In this particular arrangement, the section is closed by winding the top wire of the preceding cylinder section below the bottom cylinder of the next cylinder section, and by guiding the web being supported by this top wire to the next top cylinder. The wire and the web supported by the wire are arranged to touch the top cylinder at a small angle. Even though this provides general advantages, this well-known solution has not faultlessly functioned in practice, in all respects.

SUMMARY OF THE INVENTION

Accordingly, it is an object of the present invention to improve guiding of a web through a multi-cylinder dryer.

It is also an object of the present invention to further develope and improve a "Pistol-Grip" draw arrangement.

It is another object of the present invention to eliminate speed-difference problems which occur in a "Pistol-Grip" draw.

It is another object of the present to provide a draw for a web in a section gap, in which there are no such problems as occured previously regarding drawing of an end of the web through the gap.

It is a further object of the present invention to provide section gap which is shorter than before i.e. in which adjacent top cylinders of successive sections may, if required be horizontally positioned closer to one another with the result that the multi-cylinder dryer is shorter than previously, or that there can be more cylinders situated n the same space which thus increases the capacity of the drier.

These and other objects are attained by a multi-cylinder dryer in a paper machine, comprising a plurality f successive cylinder sections, at least one of which has a twin-wire draw in a manner such that a web being dried is drawn unsupported between cylinder rows, and in which a closed draw is arranged in a gap between the sections in a manner such that a drying or supporting wire of a preceding section is led to touch a top cylinder of a following section at a small angle. More particularly, a section gap cylinder is situated near the section gap, and is either not driven or is coupled to a drive of the preveding section. The drying or supporting wire is wound over a sector of the section gap cylinder and either constitutes a single wire draw or a top wire of a twin-wire draw of the preceding section. Furthermore, the drying or supporting wire is arranged for supporting and guiding the web as a substantially vertical run between the sector of the section gap cylinder and the top cylinder of the following section.

The sector is preferably greater than about 180°, while the section gap cylinder may be arranged to provide an open space therebelow, allowing removal of web waste by gravity.

For attaining the objects noted above and others which will be apparent below, the principal characteristic features of the present invention are that near the section gap, a special section gap cylinder is used which is either not driven or which, from a point of view of the drive, belongs to the preceding section, that the drying wire of the preceding section is wound over the section gap cylinder, preferably at a sector of over 180°, this drying wire being either the drying wire of a single-wire draw or a top wire of the preceding section, that the web-supported by the last-noted wire, is guided as an essentially vertical run from the sector of the section gap cylinder to the top cylinder of the next section, and that below the section gap cylinder, an open space has been arranged which enables waste web to be removed by gravity.

BRIEF DESCRIPTION OF THE DRAWINGS

The present invention will now be described in greater detail, with reference to certain exemplary embodiments illustrated in the accompanying drawings, to which the present invention is not intended to be restricted. In the drawings.

DESCRIPTION OF THE PREFERRED EMBODIMENTS

Figure 1:
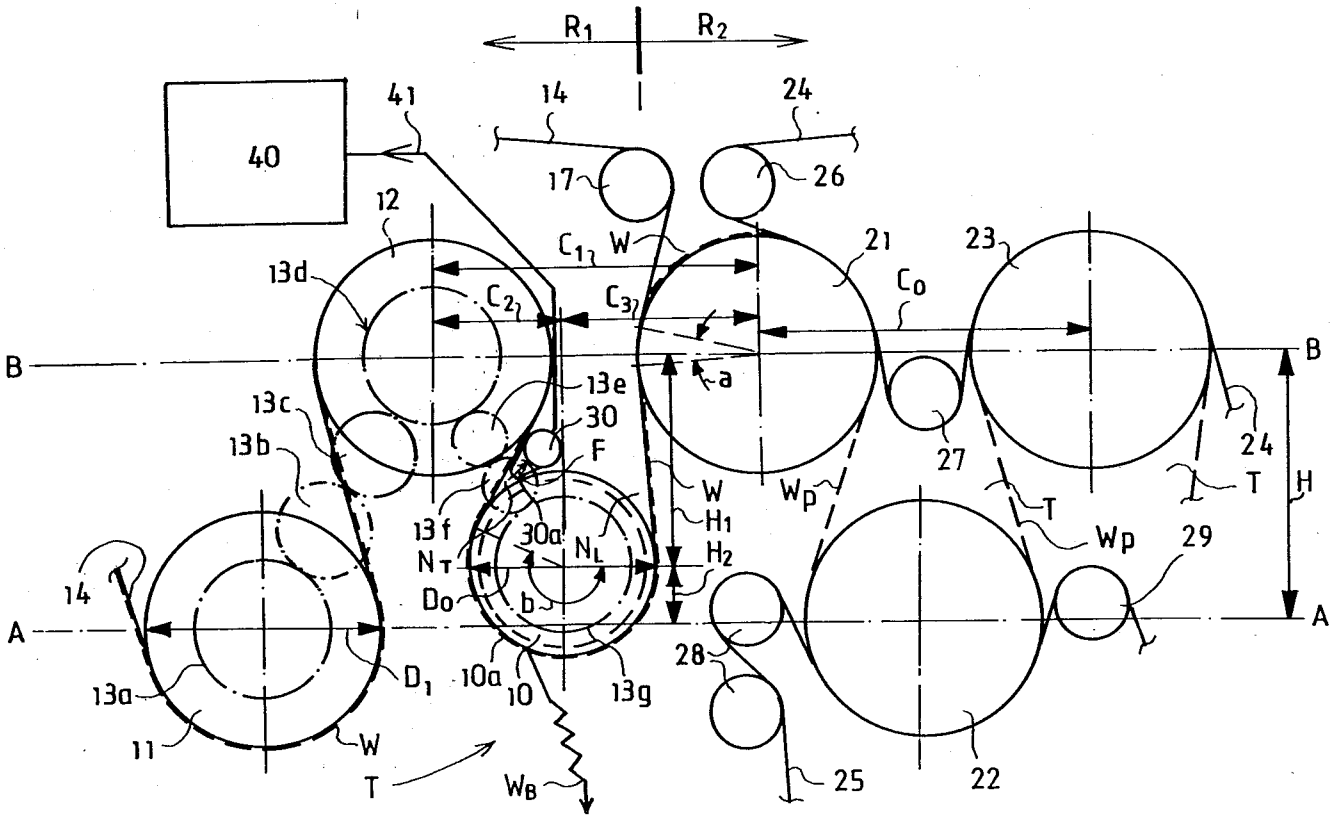
FIG. 1 is a schematic side view of how the web is drawn over a section gap from a single-wire drive section to a twin-wire section in accordance with the present invention.

Referring to FIG. 1, bottom cylinders 10 and 11 and top cylinder 12 of a preceding cylinder section Rl can be seen. Cylinders 10, 11 and 12 belong to the same drive section, with gears 13*a*, 13*b*, 13*c*, 13*d*, 13*e*, 13*f*, and 13*g* being illustrated with dotted phantom lines, the cylinders of the cylinder section $R_1$ being rotated through these gears by means of power conveyed from a common drive shaft (not illustrated). Gear 13*a* is concentrically connected to the bottom cylinder 11. Similarly, gear 13*d* is connected to the top cylinder 12, and gear 13*g* is connected to the bottom cylinder 10, which is arranged to be a so-called section gap cylinder in accordance with the present invention. The section gap cylinder 10 may also be free-rotating i.e. driven by the wire itself.

The cylinder section $R_1$ is equipped with a single-wire draw, having a wire 14 guided by a guide roll 17 and other guide rolls (not illustrated). The drying wire 14 is so arranged that the cylinders 10 and 11 of the bottom row are within the loop of the wire 14, while the cylinders of the top row, of which only the last cylinder 12 is illustrated in FIG. 1, are outside the wire loop 14. The web W being dried by the cylinder section $R_1$ in FIG. 1, runs so that on the bottom cylinders it is on the outside surface of the wire, and on the top cylinders it is directly against the hot top cylinder surface, i.e. between the surface of the cylinders and the wire 14.

In FIG. 1 only top cylinders 21 and 23 and bottom cylinder 22 of the latter or following cylinder section $R_2$ are illustrated. Section $R_2$ is equipped with a twin-wire draw in a manner such that there is a top wire 24, guided by guide rolls 27 located between guide rolls 26 and cylinders 21, 23 etc. There is a bottom wire 25 in the cylinder section $R_2$ guided by guide rolls 29 located between guide rolls 28 and bottom cylinders 22.

Figure 2:
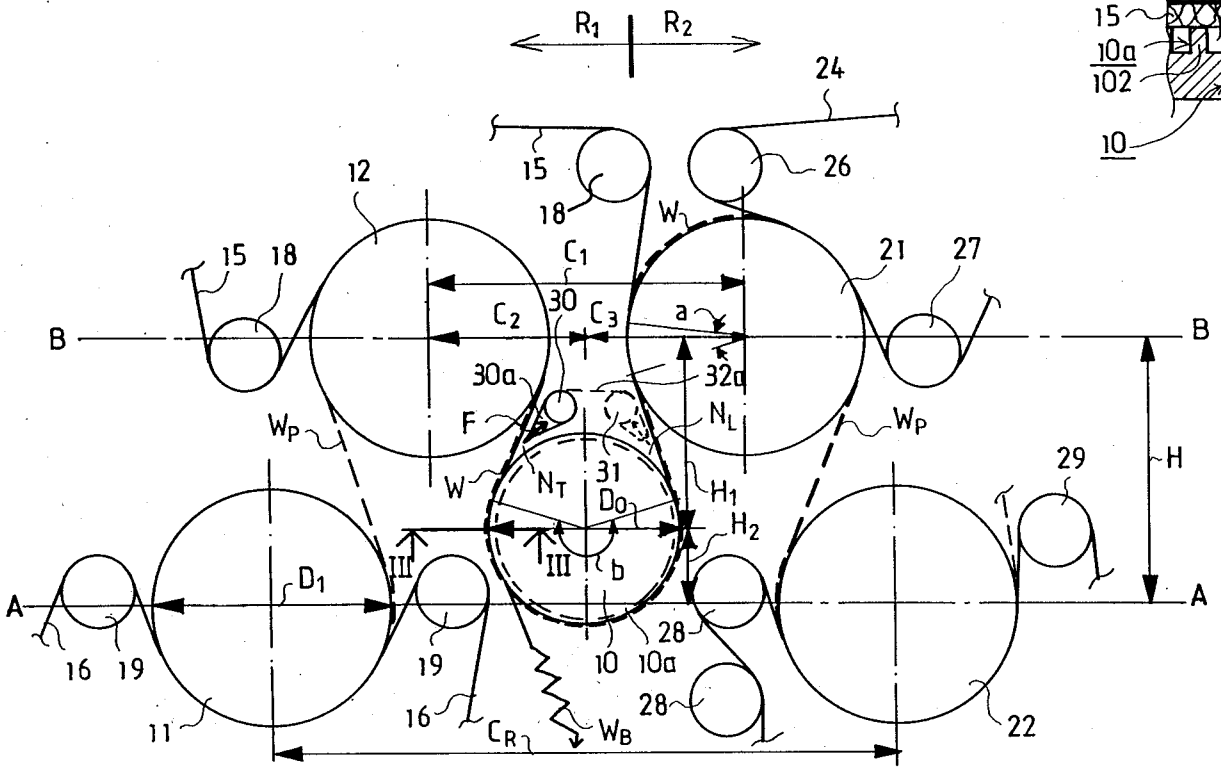
FIG. 2 is an illustration similar to FIG. 1 of how a web is drawn over a section gap draw from a twin-wire section to another twin-wire section in accordance the present invention.

As shown in FIG. 2, there is a twin-wire arrangement in the preceding section $R_1$ having a top wire 15 guided by guide rolls 18, and a bottom wire 16 guided by guide rolls 19. The top wire 15 is guided over the section gap cylinder 10 arranged in accordance with the present invention. The latter cylinder section $R_2$ is a cylinder section similar to that shown in FIG. 1 equipped with a twin-wire draw. In this section $R_2$, there are free web runs $W_p$ between the cylinder rows. In FIG. 2, the preceding section $R_1$ is wire-driven, i.e. the cylinders are driven by rotating power conveyed through the wires 15 and 16.

In the present invention, the section gap between sections $R_1$ and $R_2$ is closed, which means that the web W, is as shown in FIG. 1, supported by the drying wire 14 of the single-wire draw, or as shown in FIG. 2, supported by the top wire 15. As shown in FIG. 1, the wire 14 is guided from the cylinder 10 to the top cylinder 21 and touches the same at a small angle a, such draw arrangement corresponding in this respect to the "Pistol-Grip" draw noted above. Similarly the wire 15 is guided in FIG. 2 to touch the top cylinder 21 at an angle a. At the sector a, the web W is separated from the wire 14 or 15, and sticks to the smooth surface of the top cylinder 21. This angle a is usually in the range a=about 5°-25°, preferab;u abpit 15°.

The normal smooth-surfaced bottom cylinders 11, 22 etc of a normal multi-cylinder dryer are located in the same substantially horizontal level or plane A—A which passes through the centers of rotation thereof. Similarly, the top cylinders 12, 21, 23, etc are located in the same substantially horizontal level or plane B—B passing through the centers of rotation thereof as also illustrated. H denotes vertical difference between levels A—A and B—B. When a diameter of the normal smooth-surfaced drying cylinders 11, 12, 21, 22, 23 etc. is $D_1$=about 1839 mm this distance or height H is usually H=about 1400 to 2100 mm.

In accordance with the present invention, the last bottom cylinder of the preceding section $R_1$ is arranged to be a special section gap cylinder 10, having a diameter $D_0$ preferably smaller than the diameter $D_1$ of the normal, smooth-surfaced cylinders. Generally, $D_0=k_0D_1$ where $k_0$=about 0.3 to 1.0, preferably $k_0$=about 0.6 to 0.7. The section gap cylinder 10 (i.e. the center of rotation thereof) is positioned above the plain A—A of the bottom cylinders, at a distance $H_1$ from the plane B—B of the top cylinders, so that the rotating center of the cylinder 10 is the distance $H_2$ above the plane A—A. The distance $H_1=k_1H$, where $k_1$=about 0.5 to 1.0, preferably $k_1$=about 0.6 to 0.8.

Figure 3:
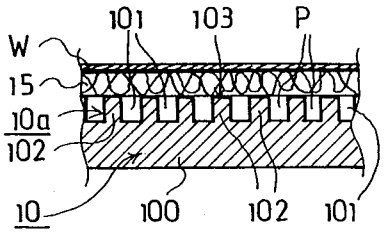
FIG. 3 is a sectional view along line III—III in FIG. 2

In an adventageous embodiment of the present invention, the section gap cylinder 10 has a grooved surface 10*a*. An exemplary embodiment of this grooved surface is illustrated in FIG. 3. As shown in this FIG., in the casing of the section gap cylinder 10 there is a grooved surface 10*a* comprising grooves 101 and ridges 102 on top of which there are cylinder surfaces 103 which contact the wire 14 or 15. The grooved surface 10*a* of the roll 10 may be made, for example, by using the G-roll technique of the assignee, in a manner such that profiled ribbon is spirally wound around the frame of the roll, in order to form continuous spiral grooves 101. The cylinder may also be a suction roll, such as for example, a suction roll described in Finnish Patent Application No. 851533 to the assignee.

As shown in FIGS. 1 and 2, a vacuum device 30, extending over the entire width of wires 14 and 15 is installed in the entry nip $N_T$ between the cylinder 10 and the wire 14 or 15. This vacuum device 30, is for example, a tubular component having a protruding part 30*a* shaped as a truncated wedge and extending as deep as possible into the wedge-shaped space of the entry nip $N_T$. The vacuum device 30 is connected by tube 41 to a suction pump 40 so that, in the direction of arrow F, such suction is created which spreads into the grooves 101 of the grooved surface 10*a*. Thus a small vacuum is created in the grooved surface 10*a* in order to improve the draw of the web W and its retention on the outer surface of the wire 14 and 15 at a cylinder sector b, preferably greater than about 180°. The vacuum device may also be the a UNA-RUN(TM) tube of the assignee.

If increase of the vacuum effect on the grooved surface 10*a* of the cylinder 10 is desired, then it is also possible to arrange another suction tube 31 functioning in the same manner as the suction tube 30, in an exit nip $N_L$ of the cylinder 10. The suction tubes 30 and 31 can also be interconnected with a wall 32*a* so that a closed vacuum space is created at a free top sector 360°−b of the cylinder 10. Tubes 30 and 31 and the wall 32*a* between them may be replaced with a special suction box essentially covering the entire free top sector 360°−b of the cylinder 10, for creating a vacuum in the grooved surface 10*a* of the roll 10.

In accordance with the present invention, the section gap $R_1-R_2$ may, if required, be horizontally shortened, which means that the top cylinders 12 and 21 of the successive sections $R_1$ and $R_2$ can be so arranged that the mutual horizontal distance which, in FIG. 2 is marked by $C_1$, is smaller than normal horizontal distance between top cylinders (i.e. between planes passing through the centers of rotation), which is marked by $C_0$ in FIG. 1. In accordance with the markings in FIG. 2, the bottom cylinder 10 is so positioned that the distance of a vertical plane passing through its center of rotation from the vertical planes passing through the centers of rotation of the top cylinders 12 and 21 is respectively $C_2$ and $C_3$. The following relationship is provided in accordance with the markings of FIGS. 1 and 2: $C_1=C_2+C_3$. When the invention is applied as in FIG. 2 between two, twin-wire draws sections, $C_2$ substantially$=C_3$ should be chosen. If the invention is applied in accordance with FIG. 1, $C_3>C_2$ should preferably be chosen.

In FIG. 2, the substantially horizontal shortening of the section gap also means that the horizontal distance between substantially vertical planes passing through centers of rotation of normal bottom cylinders 11 and 22 of the sections $R_1$ and $R_2$, is $C_R21$ $2C_0$.

The section gap cylinder 10 or a similar roll such as a suction roll, for instance UNO-VAC (TM) of the assignee, may, if required, be equipped with a separate rope draw loop (not illustrated) in order to make the drawing of the web end easier. In other words, the section gap cylinder 10 or similar roll may be equipped with a preferably loose rope draw loop, located close to one end of the roll 10 in order to facilitate the drawing of an end of a web.

In accordance with the present invention, the section gap may be made self-cleaning, as there is, under the cylinder 10, an open space T, through which the paper web $W_B$ constituting broke may be directed by gravity to a waste dryer below the multi-cylinder dryer. This is a significant advantage in practice.

When the invention is applied to a multi-cylinder dryer, all section gaps preceding the twin-wire sections are closed with a draw in accordance with the invention, such draw essentially comprising a special section gap cylinder 10, which, from the point of view of its drive, belongs to the preceding section $R_1$.

Due to the present invention, a speed difference lower than normal can be used in the section gap.

The section gap cylinder 10 is either a normal steam-heated cylinder or a non-heated cylinder or roll, or even a cooled cylinder.

The various details of the invention may vary within the inventional concepts as defined above. Therefore, the preceding description of the present invention is merely exemplary, and is not intended to limit the scope thereof in any way.

What is claimed is:

1. A multicylinder dryer in a paper machine, comprising a plurality of successive cylinder sections, at least one of which having a twin-wire draw in a manner such that a web being dried is drawn unsupported between cylinder rows, and in which a closed draw is arranged in a gap between said sections in a manner such that a drying or supporting wire of a preceding section is led to touch a top cylinder of a following section at a small angle, comprising a section gap cylinder being situated near said section gap, said section gap cylinder not driven or coupled to a drive of said preceding section, said drying or supporting wire is wound over a sector of said section gap cylinder and either constitutes a single wire draw or a top wire of a twin-wire draw of said preceding section, and said drying or supporting wire is arranged for supporting and guiding the web as a substantially vertical run between said sector of said section gap cylinder and said top cylinder of said following section.

2. The combination of claim 1, wherein said sector is greater than about 180°.

3. The combination of claim 1, wherein said section gap cylinder is arranged to provide and open space therebelow allowing removal of web waste by gravity.

4. The combination of claim 1, wherein said section gap cylinder comprises a grooved outer surface.

5. The combination of claim 4, additionally comprising means for creating a vacuum on said grooved outer surface.

6. The combination of claim 1, wherein said section gap cylinder is a suction roll having a perforated casing and an internal suction box, with a suction zone arranged at said sector of said roll.

7. The combination of claim 1, additionally comprising a suction tube situated in a wedge space of an entry nip formed between said section gap cylinder and supporting or drying wire of said preceding section, and a vacuum pump or suction blower coupled to said suction tube.

8. The combination of claim 1, wherein an open sector of said section gap cylinder which is defined by 360°—said sector about which said supporting or drying wire is wound, is equipped with and covered by a suction box connected to a vacuum pump or to a suction side of a centrifugal blower.

9. The combination of claim 1, wherein a diameter $D_0$ of said section gap cylinder is smaller than diameter $D_1$ of normal drying cylinders in said multicylinder dryer.

10. The combination of claim 9, wherein $D_0=k_0D_1$ wherein $k_0$=about 0.3 to 1.0.

11. The combination of claim 10, wherein $k_0$=about 0.6 to 0.7.

12. The combination of claim 9, wherein said section gap cylinder is mounted with a center of rotation thereof located above a plane passing through centers of rotation of bottom cylinders in said multi-cylinder dryer.

13. The combination of claim 12, wherein said section gap cylinder rotation center is located below a plane passing through top cylinders of said multicylinder dryer by a distance $H_1=k_1H$, where H is distance between said respective planes through said top and bottom cylinders centers of rotation, and $K_1$ is a constant.

14. The combination of claim 13, wherein $k_1$=about 0.5 to 1.0.

15. The combination of claim 14, wherein $k_1$=about 0.6 to 0.8.

16. The combination of claim 1, wherein distance of said gap between said sections is shortened as compared to normal distance between cylinders of the same row.

17. The combination of claim 16, wherein distance $C_1$ between planes passing through respective centers of rotation of adjacent top cylinders of said preceding and following sections is smaller than distance $C_0$ between planes passing through centers of rotation between other adjacent top cylinders of said multicylinder dryer.

18. The combination of claim 17, wherein distance $C_R$ between planes passing through respective centers of rotation of adjacent bottom cylinders of said preceding and following sections, is $<$about $2>C_0$.

19. The combination of claim 17, wherein $C_1=k_2C_0$ where $k_2$=about 0.5 to 1.0.

20. The combination of claim 19, wherein $k_2$=about 0.6 to 0.8.

21. The combination of claim 17, wherein $C_1$ is equal to the sum of distance $C_2$ between planes passing through respective centers of rotation of said adjacent top cylinder of said preceding section and said section gap cylinder, and distance $C_3$ between planes passing through said respective centers of rotation of said section gap cylinder and said adjacent top cylinder of said following section.

22. The combination of claim 21, wherein $C_2$ and $C_3$ are substantially equal.

23. The combination of claim 21, wherein $C_3>C_2$.

24. The combination of claim 1, additionally comprising a loose rop draw loop located close to one end of said section gap cylinder, in order to facilitate drawing of an end of the web.

25. The combination of claim 1, wherein said angle is about 5° to 25°.

26. The combination of claim 25, wherein said angle is about 15°.

27. The combination of claim 13, wherein H=about 1400 to 2100 mm.

28. The combination of claim 27, wherein $D_1$=about 1839 mm.

29. The combination of claim 7, additionally comprising a second suction tube situated in a wedge space of an exit nip formed between said section gap cylinder and supporting or drying wire of said preceding section and coupled to said pump or blower.

* * * * *